US008878863B2

(12) United States Patent
Kato et al.

(10) Patent No.: US 8,878,863 B2
(45) Date of Patent: Nov. 4, 2014

(54) PORTABLE TERMINAL

(75) Inventors: Masataka Kato, Tokyo (JP); Makoto Kawamura, Tokyo (JP)

(73) Assignee: Fujitsu Mobile Communications Limited, Kawasaki (JP)

( * ) Notice: Subject to any disclaimer, the term of this patent is extended or adjusted under 35 U.S.C. 154(b) by 471 days.

(21) Appl. No.: 12/407,104

(22) Filed: Mar. 19, 2009

(65) Prior Publication Data

US 2010/0026694 A1 Feb. 4, 2010

(30) Foreign Application Priority Data

Aug. 4, 2008 (JP) ..... P2008-201212

(51) Int. Cl.
*G09G 5/399* (2006.01)
*G09G 5/39* (2006.01)
*G09G 5/393* (2006.01)

(52) U.S. Cl.
CPC ..... *G09G 5/39* (2013.01); *G09G 5/399* (2013.01); *G09G 2340/12* (2013.01); *G09G 5/393* (2013.01)
USPC ..... 345/539; 345/531

(58) Field of Classification Search
USPC ..... 345/441, 649
See application file for complete search history.

(56) References Cited

U.S. PATENT DOCUMENTS

| | | | | |
|---|---|---|---|---|
| 5,629,723 | A * | 5/1997 | West et al. | 345/539 |
| 5,742,788 | A * | 4/1998 | Priem et al. | 711/110 |
| 6,038,034 | A * | 3/2000 | Nishio et al. | 358/404 |
| 6,288,722 | B1 * | 9/2001 | Narayanaswami | 345/619 |
| 2003/0095125 | A1 * | 5/2003 | Lim et al. | 345/539 |
| 2007/0139445 | A1 * | 6/2007 | Khan et al. | 345/649 |
| 2007/0291037 | A1 * | 12/2007 | Blaukopf et al. | 345/441 |

FOREIGN PATENT DOCUMENTS

| | | | |
|---|---|---|---|
| JP | 2006-171244 | A | 6/2006 |
| JP | 2006-171488 | A | 6/2006 |
| JP | 2006-276269 | A | 10/2006 |

OTHER PUBLICATIONS

JP Office Action mailed on Feb. 5, 2013 in application No. 2008-201212.

* cited by examiner

*Primary Examiner* — Phi Hoang
(74) *Attorney, Agent, or Firm* — Maschoff Brennan

(57) ABSTRACT

The portable terminal includes a display unit configured to display a screen; a first buffer and a second buffer configured to sequentially store display data for the displayed screen; a first determination unit configured to determine whether to perform single-buffer control or double-buffer control based on update data for the displayed screen; and a setting unit configured to set, if single-buffer control is appropriate, a display control method of the display unit to a display control method using the first buffer and to set, if double-buffer control is appropriate, a display control method of the display unit to a display control method using the first buffer and the second buffer.

4 Claims, 12 Drawing Sheets

※EXAMPLE OF CASE WHERE UPDATING PROCESSING IS EXECUTED AT ALMOST SAME TIME AS REFRESHING PROCESSING FOR SHORTER PERIOD THAN REFRESHING PROCESSING

※EXAMPLE OF CASE WHERE UPDATING PROCESSING IS EXECUTED AT ALMOST SAME TIME AS REFRESHING PROCESSING FOR SHORTER PERIOD THAN REFRESHING PROCESSING

PORTABLE TERMINAL

BACKGROUND OF THE INVENTION

1. Field of the Invention

The present invention relates to a portable terminal capable of switching a display memory such as VRAM based on data displayed on a screen.

2. Related Art

Along with recent tendency toward a high-definition display device (display) in a portable terminal such as a cellular phone, an allowable maximum amount of data displayed on a screen has been increased and much information has been provided to a user at a time. However, the increase in amount of data displayed on the screen leads to a longer update time. As a result, responsiveness to a user operation is deteriorated.

In a case where a refresh rate for refreshing a display and a display memory (hereinafter referred to as "frame buffer") are paired (i.e., single buffer case) in a portable terminal, processing for writing data to the frame buffer (update) and processing for reading display data are executed in an asynchronous fashion. In this case, if the update direction for writing and the update direction for reading are the same, and the writing processing and the reading processing are executed at the same time, or if the update direction for writing and the update direction for reading are at 90 degrees, tearing occurs upon each updating.

The term "tearing" means such a phenomenon that since a timing at which screen data is updated and a timing at which display data is read are not synchronized, screens generated at different timings are concurrently displayed in upper and lower portions or on the right and left portions of the display, and a user catches flickers on the display. In general, if the writing direction and the reading direction cross each other at 0 degrees, tearing appears linearly in the same direction as the updating direction. On the other hand, if the writing direction and the reading direction cross each other at 90 degrees, tearing appears diagonally.

To avoid such tearing, Japanese Unexamined Patent Application Publication No. 2006-171488 discloses an image display device that uses two frame buffer areas for displaying an image according to a double-buffer method under a normal condition or just before image transfer to a nonvolatile memory, and at the time of transferring an image to the nonvolatile memory, switches the double-buffer method to a single-buffer method to use one of the frame buffer areas and transfers an image from the other frame buffer not used for image display toward a nonvolatile memory NVRAM, for example.

In general, at the time of displaying a screen on a display of a portable terminal, a frame buffer IC (driver) for controlling image data (for example, VRAM) to be finally outputted to the display uses two or more VRAMs to separately prepare a VRAM for current display and a VRAM for updating to thereby control display. If the portable terminal includes two or more VRAMs, the entire screen area should be updated each time to synchronize displayed data. On the other hand, in the case of using one VRAM, it is only necessary to update an area corresponding to a difference from a previous screen. As a result, a processing time can be shortened, but the updating processing and display processing are performed using the same VRAM, thus leading to tearing and reduction in image quality of a display screen.

Further, the reduction in image quality of a display screen is ignorable depending on displayed data. Thus, if a VRAM control method can be switched according to displayed data, a performance for the display processing could be increased.

In this case, it is desirable to select a VRAM control method without modifying a higher-level application program.

SUMMARY OF THE INVENTION

The present invention has been accomplished in view of the above circumstances, and it is accordingly an object of the invention to provide a portable terminal that improves a performance for updating a screen by switching display memories according to displayed data such as a VRAM as appropriate and increases responsiveness to a user operation by reducing a load.

In order to achieve the above and other objects, the present invention provides a portable terminal comprising:

a display unit configured to display a screen;

a first buffer and a second buffer configured to sequentially store display data for the screen displayed by the display unit;

a first determination unit configured to determine whether single-buffer control or double-buffer control is performed based on update data for the screen displayed by the display unit; and a setting unit configured to set, if the first determination unit determines that the single-buffer control is appropriate, a display control method of the display unit to a display control method using the first buffer and to set, if the first determination unit determines that the double-buffer control is appropriate, a display control method of the display unit to a display control method using the first buffer and the second buffer.

In a preferred embodiment, the portable terminal may further include a storage unit configured to store attribute information of the screen displayed by the display unit, wherein the first determination unit determines whether the single-buffer control or the double-buffer control is performed based on the attribute information stored in the storage unit.

It may be desired that the storage unit is configured to store information as to whether target data is a moving image as the attribute information of the screen or not, and the first determination unit is configured to determine that single-buffer control is appropriate if the data displayed by the display unit is not a moving image, based on the attribute information stored in the storage unit and determines that the double-buffer control is appropriate if the data displayed with the display unit is a moving image, based on the attribute information stored in the storage unit.

It may be also desired that the storage unit stores the attribute information of each of a plurality of layers in the screen displayed by the display unit, and the first determination unit determines that the double-buffer control is appropriate if one of the plurality of layers is a moving image, based on the attribute information stored in the storage unit and determines that the single-buffer control is appropriate if none of the plurality of layers is a moving image, based on the attribute information stored in the storage unit.

The portable terminal may further include a second determination unit configured to determine whether a direction in which data is written to the first buffer or the second buffer is the same as a direction in which data is read from the first buffer or the second buffer, and the first determination unit determines that single-buffer control is appropriate if the second determination unit determines that the two directions are the same and determines that double-buffer control is appropriate if the second determination unit determines that the two directions are not the same.

According to the portable terminal of the present invention of the characters mentioned above, it is possible to improve a performance for updating a screen by switching display memories according to displayed data such as a VRAM as appropriate as well as increase responsiveness to a user operation by reducing a load.

The nature and further characteristic features of the present invention will be made clearer from the following descriptions made with reference to the accompanying drawings.

DESCRIPTION OF THE PREFERRED EMBODIMENTS

Figure 1A:
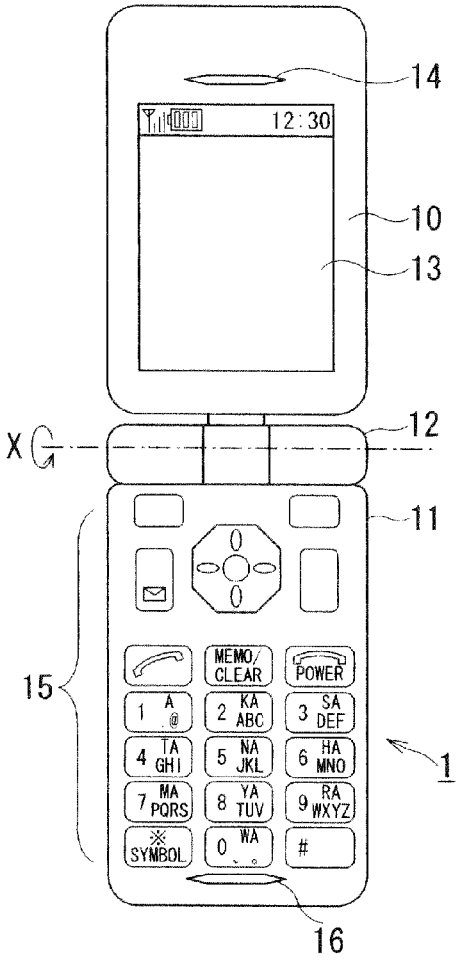
FIGS. 1A and 1B are front view and side view showing an opened information processing device (i.e., cellular phone) according to the present invention, respectively.
Figure 1B:
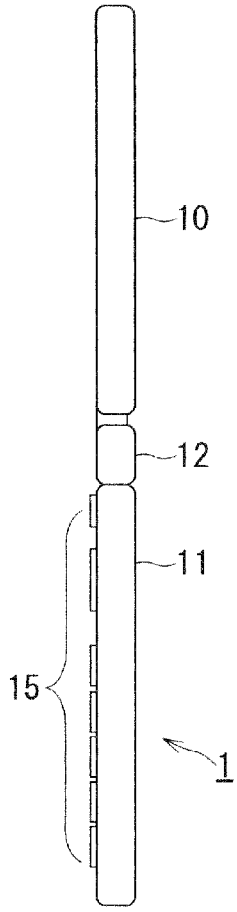
Figure 2A:
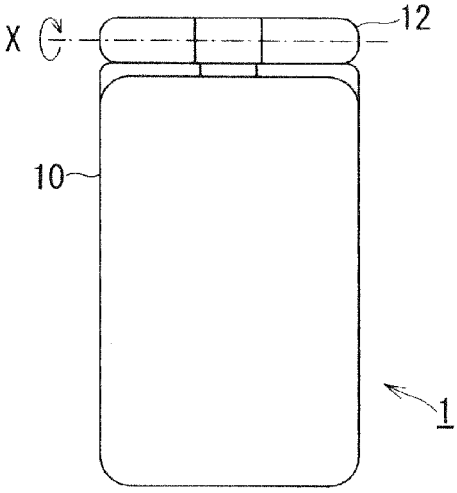
FIGS. 2A and 2B are front view and side view of a closed information processing device (i.e., cellular phone) according to the present invention, respectively.
Figure 2B:
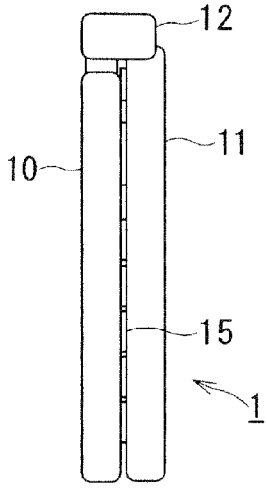

Hereinafter, a portable terminal as an example of an information processing device according to the present invention will be described with reference to the accompanying drawings, and a clamshell cellular phone 1 will be described as an example of such a portable terminal according to the present invention.

As shown in FIGS. 1A and 1B and FIGS. 2A and 2B, the cellular phone 1 is composed of an upper case 10 having a rectangular plate shape and a lower case 11 having almost the same shape as the upper case 10. The upper case 10 and the lower case 11 are designed to completely overlap each other in a closed, i.e., folded, state. The upper case 10 and the lower case 11 are hinge-coupled across a hinge portion 2. The upper case 10 is pivotal about the hinge portion 12 with respect to the lower case 11 by a predetermined angle in an X direction in FIGS. 1A and 1B and FIGS. 2A and 2B. The cellular phone 1 is changed from a closed state to an opened state or from an opened state to a closed state by rotating the upper case 10 relative to the lower case 11.

A display 13 for displaying display information including characters and images is provided in an inner surface of the upper case 10 (surface opposite to the lower case 11). The display 13 is, for example, a liquid crystal display using a liquid crystal panel or an organic EL display using an organic EL panel. The liquid crystal panel is a display panel that changes the direction (orientation) of each liquid crystal grain by applying a voltage to liquid crystal to realize a shutter to control light to thereby shield or transmit light emitted from a light source such as a backlight to display predetermined data.

Further, the organic EL panel is a display panel that displays data utilizing such a phenomenon that light is emitted from excitons generated through recombination between electrons and holes injected into an organic compound. Further, a speaker 14 that outputs sound is provided in the inner surface of the upper case 10.

In an inner surface of the lower case 11 (surface opposite to the upper case 10) there are arranged operation keys 15 including a power key for switching on/off a power supply, a call key for making a call, a numerical keypad for inputting numerics or characters, and shortcut keys for starting a mail function or a Web browser function, for example. A microphone 16 for collecting sounds is also provided.

Referring next to a block diagram of FIG. 3, functions of the cellular phone 1 will be described.

Figure 3:
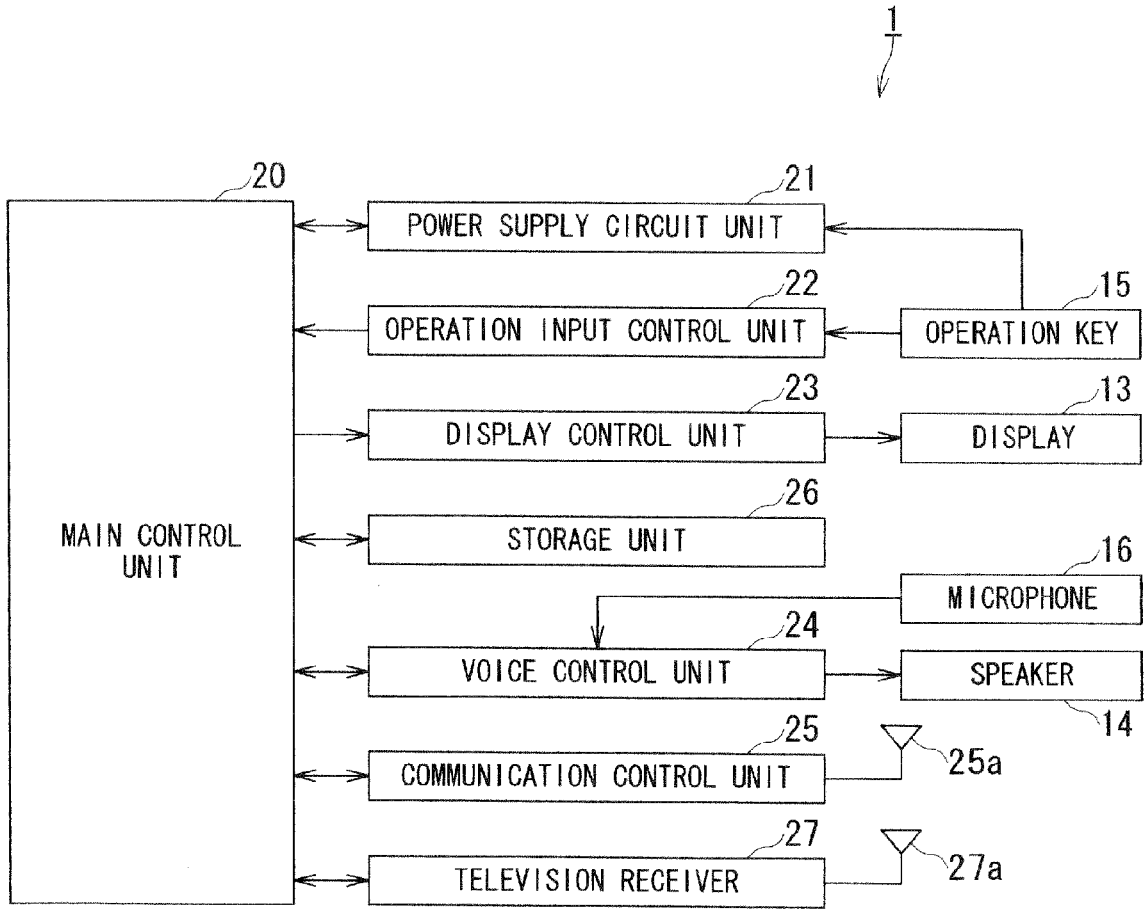
FIG. 3 is a functional block diagram of a portable terminal as a typical example of the information processing device according to the present invention.

As shown in FIG. 3, the cellular phone 1 includes a main control unit 20, a power supply control unit 21, an operation input control unit 22, a display control unit 23, a sound control unit 24, a communication control unit 25, a storage unit 26, and a television receiver 27, which are connected together via a bus in a communicable manner.

The main control unit 20 includes a CPU (Central Processing Unit) for performing various kinds of computing processing, and executes overall control for the cellular phone 1 as well as executes the following display control processing or various other computing processing and control processing. The power supply control unit 21 switches on/off a power supply in response to user's inputting made through the operation keys 15. If the cellular phone is powered on, a power source (battery etc.) supplies power to each unit to get the cellular phone 1 operable.

The operation input control unit 22 includes an input interface for the operation keys 15. If detecting that any one of the operation keys 15 was pressed, the operation input control unit 22 generates a signal indicating the pressed key and sends the signal to the main control unit 20. The display control unit 23 includes a display interface for the display 13, and displays characters and images on the display 13 under the control of the main control unit 20.

The sound control unit 24 generates an analog sound signal based on sounds collected with the microphone 16 under the control of the main control unit 20, and converts the analog sound signal to a digital sound signal. If receiving the digital sound signal, the sound control unit 24 converts the digital sound signal to an analog sound signal, which is then outputted from the speaker 14 in the form of sound.

The communication control unit 25 subjects a reception signal received from a base station through an antenna 25*a* to spectrum-despreading processing to thereby reconstruct data. The data is transmitted to the sound control unit 24 and outputted from the speaker 14 or transmitted to the display control unit 23 and displayed on the display 13 or recorded in the storage unit 26 according to an instruction of the main control unit 20.

Further, if receiving sound data collected by the microphone 16, data input using the operation keys 15 and data stored in the storage unit 26, the communication control unit 25 executes spectrum-spreading processing on these data and sends the resultant data to the base station through the antenna 25*a* under the control of the main control unit 20.

The storage unit 26 is composed of a ROM or a hard disk for storing processing programs regarding processing executed with the main control unit 20 or data necessary for the processing, a nonvolatile memory, a database, and a buffer for temporarily storing data used when the main control unit 20 performs processing. In addition, a processing program necessary for the following display control processing executed with the main control unit 20 is stored in, for example, the ROM.

The television receiver 27 includes a television antenna 27*a* and receives television broadcasting such as terrestrial digital one-segment broadcasting, terrestrial digital broadcasting, and terrestrial three-segment radio broadcasting through the television antenna 27*a*. Then, the television receiver 27 separates the received television broadcasting data into sound signals and image signals, and the image signals are displayed on the display with the display control unit 23 and outputs the sound signals are outputted from the speaker 14 with the sound control unit 24 for television viewing.

Figure 4:
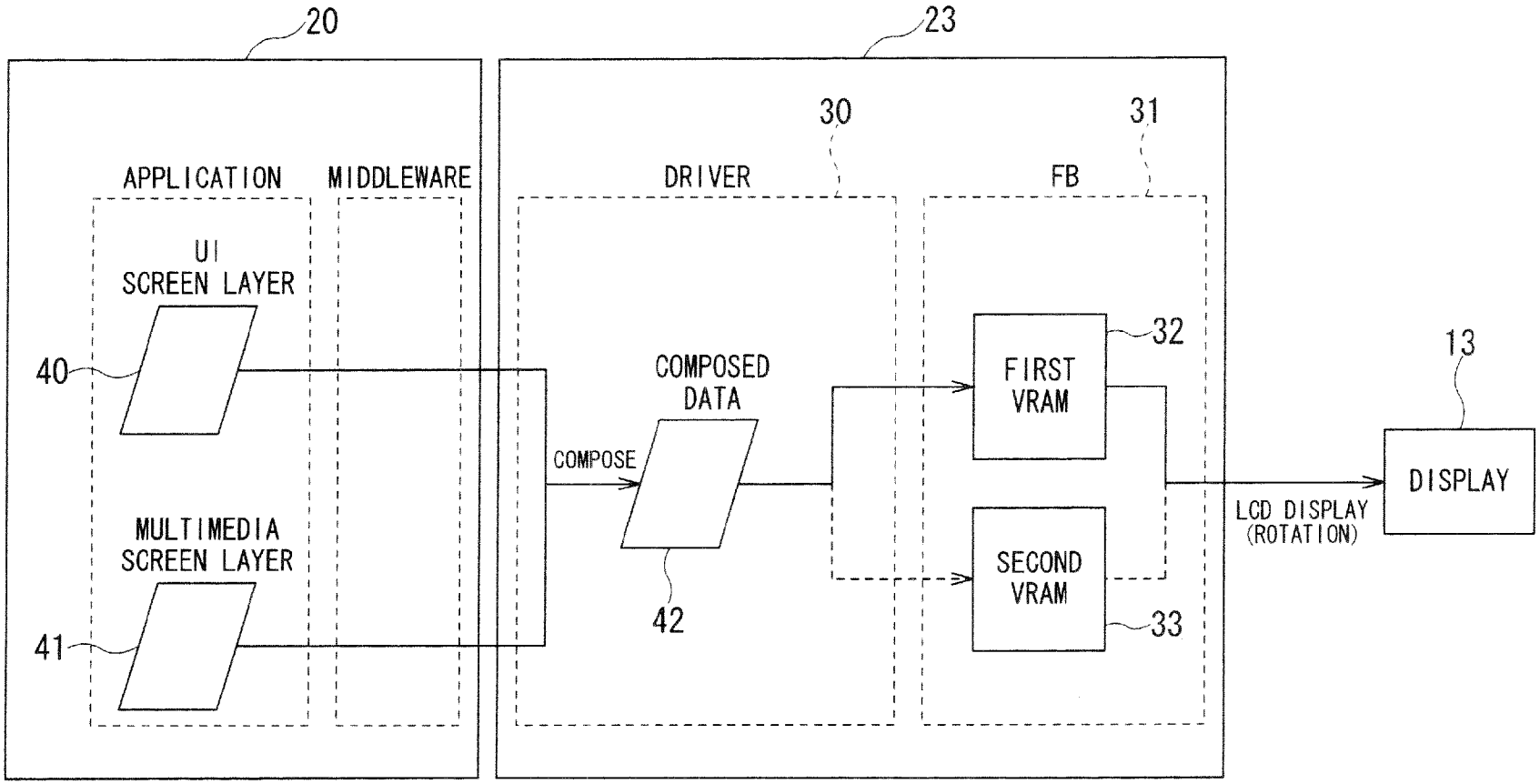
FIG. 4 is a schematic diagram of display control processing in the portable terminal according to the present invention.
Figure 5:
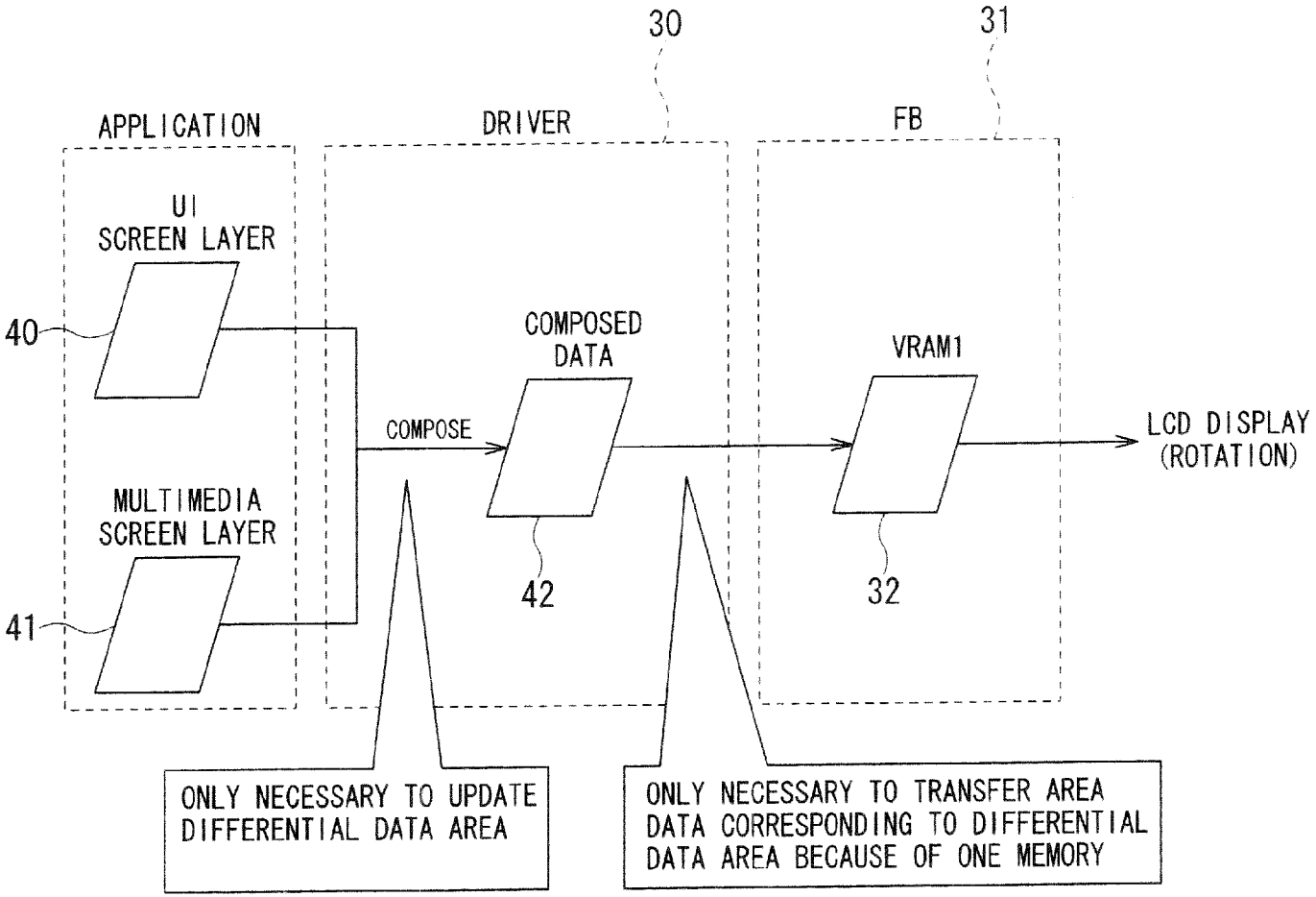
FIG. 5 is a schematic diagram of a display control method using single-buffer control (single buffer) in the portable terminal according to the present invention.

As shown in FIG. 4, if the main control unit 20 starts to execute an application program in the cellular phone 1, plural screen layers are generated under the control of the application program. Examples of the screen layers include a UI screen layer 40 for displaying information a user uses to operate the cellular phone 1, and a multimedia screen layer 41 for displaying moving images. These plural screen layers are composed by the display control unit 23 and displayed on the display 13.

The display control unit 23 includes a driver 30 for displaying a screen on the display 13 based on screen layers generated by the main control unit 20 and an FB 31 for temporarily stoning display data of a screen displayed on the display 13. The driver 30 composes the plural screen layers generated with the main control unit 20 so as to obtain composed data 42. The FB 31 includes plural VRAMs including at least a first VRAM 32 and a second VRAM 33. The FB displays the composed data 42 obtained by the driver 30 on the display 13 using one or more of the VRAMs.

Further, the display 13 is controlled by the display control unit 23 based on a method for updating a screen using one VRAM (for example, the first VRAM 32) or a method for updating a screen using plural VRAMs (for example, the first VRAM 32 and the second VRAM 33) at the time of displaying the screen on the display 13.

An input side switch is provided on an input side of each of the first VRAM 32 and the second VRAM 33. The input side switch switches a transfer destination of update data for updating the display 13 between the first VRAM 32 and the second VRAM 33 according to an instruction of the main control unit 20. If receiving update data to be displayed on the display 13, the input side switch transfers the update data to the connected VRAM (the first VRAM 32 or the second VRAM 33).

An output side switch is provided on an output side of each of the first VRAM 32 and the second VRAM 33. The output side switch switches a transfer source of update data for updating the display 13 between the first VRAM 32 and the second VRAM 33. The main control unit 20 loads the update data for updating the display 13 from the VRAM connected through the output side switch (the first VRAM 32 or the second VRAM 33) and executes control to update the display 13.

Further, a rate at which update data is written to the first VRAM 32 or the second VRAM 33 is different from a rate at which update data is read from the first VRAM 32 and the second VRAM 33 (for example, data is written at a rate of 10 times per second and data is read at a rate of 20 times per second).

Here, in the cellular phone 1, the driver 30 composes plural screen layers generated based on the running application programs under the control of middleware, and the FB 31 transfers the composed data 42 to the display 13 to thereby display a screen on the display 13. At this time, the composed data 42 is temporarily stored in the VRAM in the FB 31 controlling the display 13. Then, the composed data 42 stored in the VRAM is referenced at a given interval corresponding to a predetermined refresh rate to thereby display the data on the display 13.

Thus, as mentioned above, the general cellular phones only need to have VRAMs for one or more screens. In the case of using only one VRAM, tearing might occur if data is displayed according to a refresh rate and displayed data is updated at the same timing. Thus, if a higher priority is given to an image quality of a display screen, two or more VRAMs are used to separately prepare a display VRAM and an update VRAM so as not to display an image being updated on the display 13 to thereby prevent tearing.

On the other hand, in the case of using only one VRAM, it is only necessary to update an area corresponding to differential data, while in the case of using two or more VRAMs, it is always necessary to update the whole area (or synchronize (copy) displayed data between plural VRAMs prior to updating), resulting in an increase in update time.

Further, in the case of using only one VRAM, tearing occurs in a display screen but does not last for a long time and is eliminated upon the next refresh time. Thus, the visibility of tearing varies depending on displayed data. In other words, tearing is conspicuous in displayed data including a large difference between frames like moving images of television broadcasting or the like. However, in the case of displaying a UI screen such as a mail screen or a menu screen, a difference between previous data and updated data is small, tearing is inconspicuous. Therefore, if display control can be executed on the VRAMs in the FB 31 in consideration of displayed data, a performance in updating a screen could be improved.

Figure 6A:
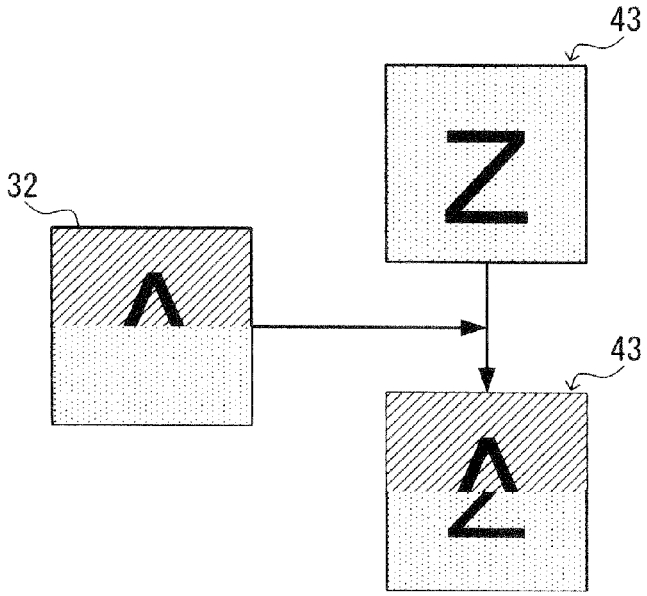
FIGS. 6A and 6B illustrate single-buffer control (single buffer)
Figure 6B:
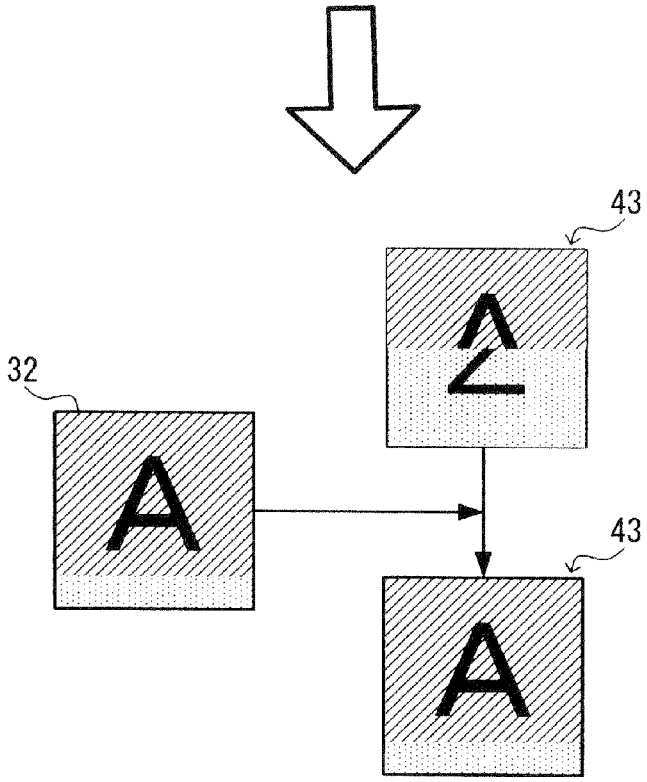

According to the method using only one VRAM (single buffer), as shown in FIG. 5 and FIGS. 6A to 6C, update data that have been inputted to one VRAM (for example, the first VRAM 32) are transferred in succession to the display 13 and displayed on the display 13. For example, in such a case that the first VRAM 32 inputs update data for displaying a character "A" under such a condition that a character "Z" is displayed on a display screen 43 as shown in FIG. 6A, since data inputted to the first VRAM 32 are successively displayed on the display screen 43, if a writing rate is lower than a display updating rate, the characters "Z" and "A" might be concurrently displayed in a partially-overlapping form as shown in FIGS. 6A and 6B.

Figure 7:
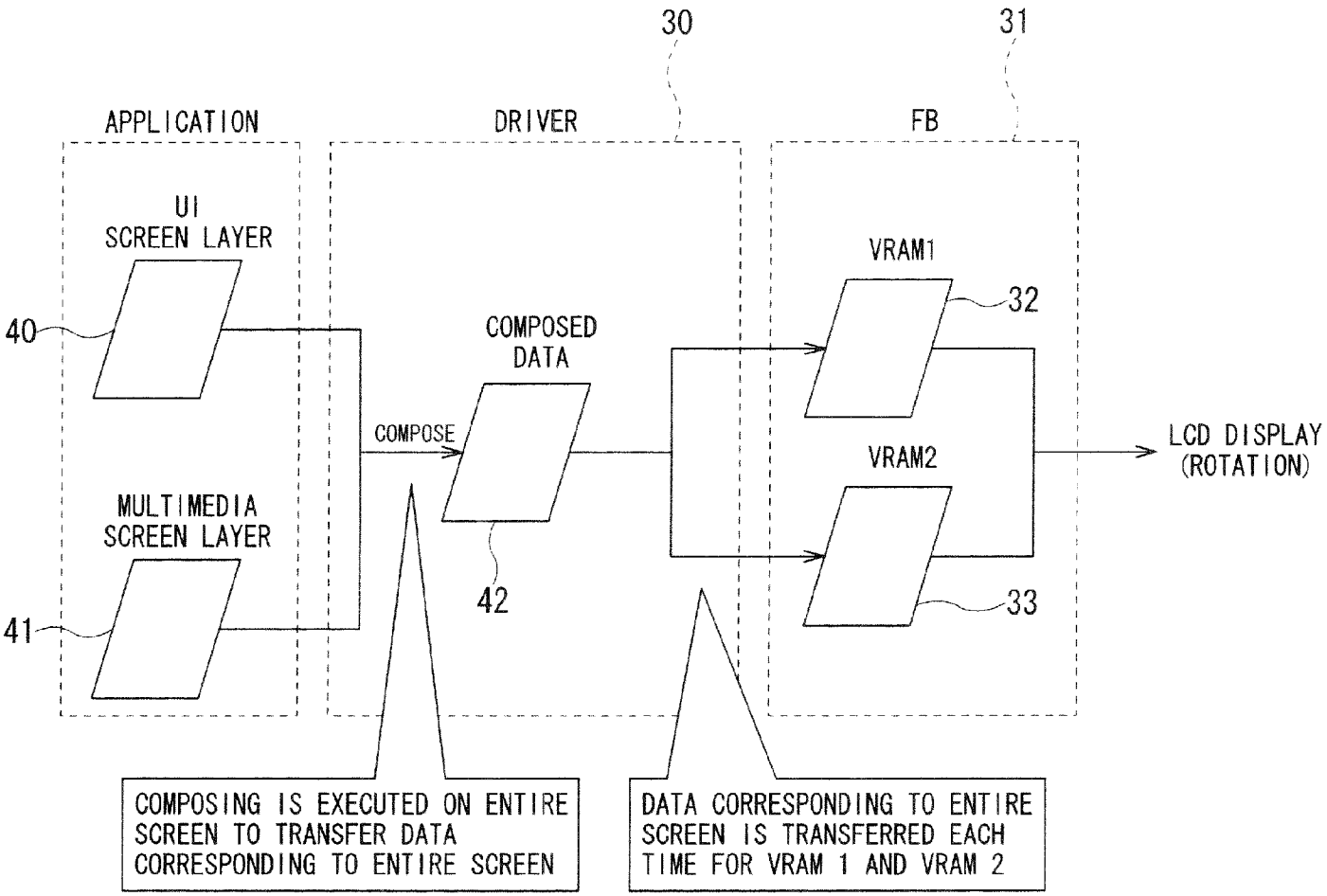
FIG. 7 is a schematic diagram of a display control method using double-buffer control (double buffer) in the portable terminal according to the present invention.
Figure 8A:
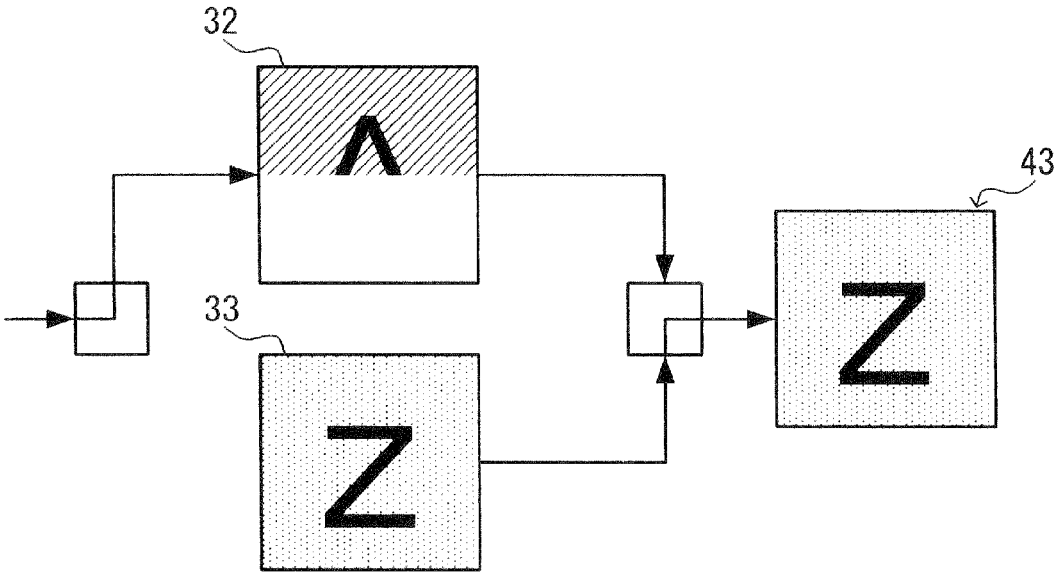
FIGS. 8A and 8B illustrate a double-buffer control (double buffer)
Figure 8B:
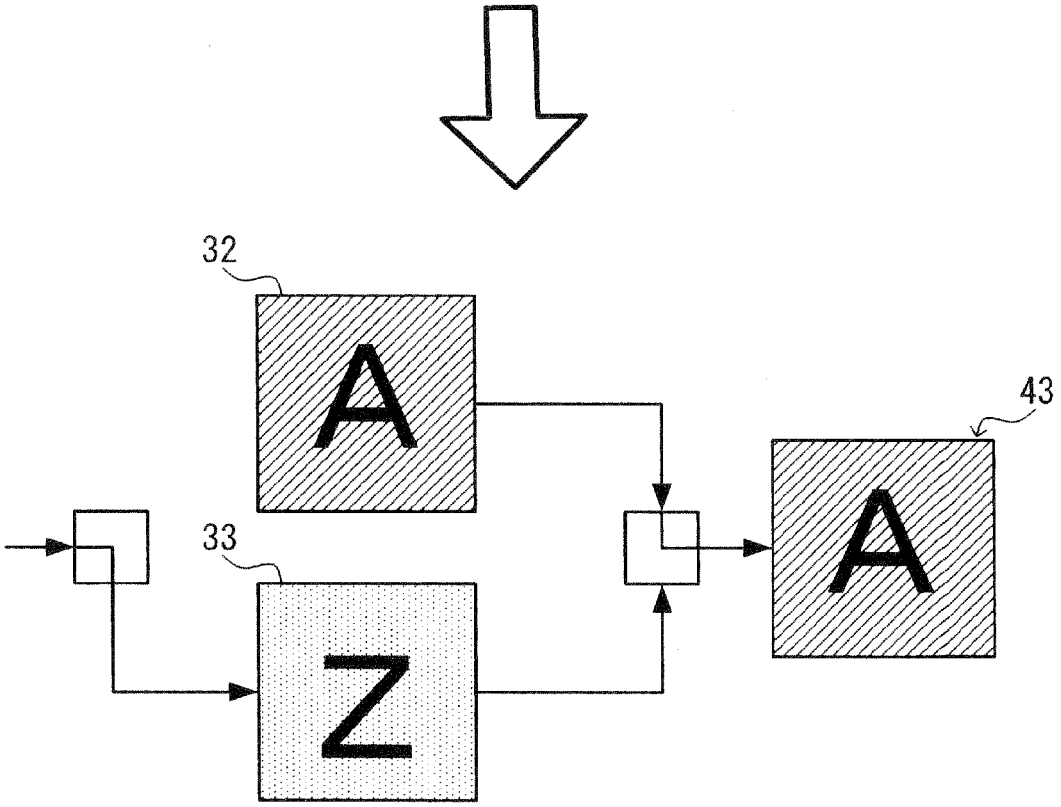

According to the method using two or more VRAMs (double buffer), as shown in FIG. 7 and FIGS. 8A and 8B, update data is inputted to any one of the plural VRAMs, and upon the completion of inputting the data, the data in the VRAM is displayed on the display screen 43 under the control. Here, while one VRAM receives the update data, the other VRAMs output previous display data. For example, as shown in FIG. 8A, if update data for displaying the character "A" to be displayed next when the character "Z" outputted from the second VRAM 33 is being displayed on the display screen 43, the character "Z" outputted from the second VRAM 33 is continuously displayed on the display screen 43 while the update data is inputted. Then, upon the completion of inputting the update data for displaying the character "A" to the first VRAM 32, as shown in FIG. 8A, the first VRAM 32 transfers the update data to the display 13 to display the character "A" on the display screen 43. In this case, the next update data is inputted to the second VRAM 33.

In the case of using the single buffer for updating a screen, it is only necessary to compose data only in a differential data area upon composing plural screen layers and transfer update data for the differential area to the display 13. Further, as soon as update is inputted to a memory, the memory outputs the update data to the display 13. Thus, the single buffer is advantageous in terms of high display processing. On the other hand, in the case of using the single buffer, for example, in the illustrated examples of FIGS. 6A and 6B, the currently displayed character "Z" and the character "A" as update data might be displayed on the same screen depending on timing, which leads to a defect that tearing might occur in the display screen 43.

On the other hand, in the case of using the double buffer for updating a screen, it is necessary to compose an area corresponding to the entire screen upon composing plural screen layers to transfer update data for the entire screen to the display 13. Further, while one memory receives update data, the other memories output display data. After the completion of update data inputted to the one memory, the update data is outputted to the display 13. Thus, the double buffer has an advantage that previous display data and the next display data are not displayed on the same screen and no tearing occurs but has a disadvantage that display processing takes much time because update data is not outputted to the display 13 until the memory received all of the update data.

Further, in the case of updating the display screen 43 of the display 13, a high priority is given to a high image quality of the display screen or a high display processing speed. For example, in the case of reproducing moving images of television broadcasting, the degree of change in displayed data on the screen is large, and thus, tearing discomforts a user and an easy-to-view display is prioritized. On the other hand, in the case of displaying a menu screen or a Web browser screen, the degree of change in displayed data on the screen is small, and thus, tearing does not bother a user so much, and a high display processing speed precedes a high image quality of the display screen.

FIGS. 9A to 9E show an example of how tearing occurs in the case where a direction (update direction) in which display data is written is the same as a direction (refresh direction) in which display data is read on the display 13.

Figure 9A:
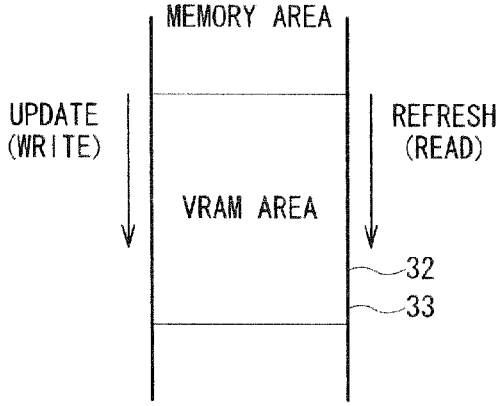
FIG. 9A shows an example of a way how a memory area is used when the portable terminal performs display control processing.
Figure 9B:
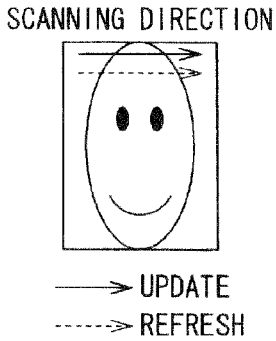
FIG. 9B shows a direction (update direction) in which display data is written and a direction (refresh direction) in which display data is read on a display.
Figure 9C:
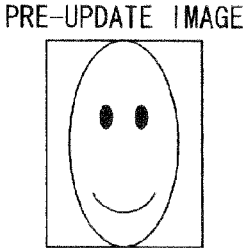
FIG. 9C shows the original (pre-update) image displayed on a display.
Figure 9D:
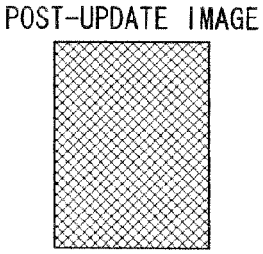
FIG. 9D shows an updated (post-update) image displayed on a display.
Figure 9E:
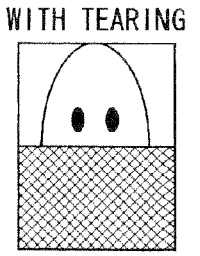
FIG. 9E shows a screen example displayed on a display.

FIG. 9A shows an example of how a memos area is used when the cellular phone 1 performs display control processing. FIG. 9B shows a direction (update direction) in which display data is written and a direction (refresh direction) in which display data is read on the display 13. FIG. 9C shows the original (pre-update) image displayed on the display 13. FIG. 9D shows an updated mage displayed on the display 13. FIG. 9E shows a screen example displayed on the display 13.

As shown in FIGS. 9A to 9E, if a rate (update rate) at which update data is written to the VRAM (the first VRAM 32 or the second VRAM 33) is different from a rate (refresh rate) at which update data is read from the VRAM and in this case, a write direction and a read direction are the same, tearing occurs in the display screen 43 in the same direction as a scanning direction. For example, if writing processing and reading processing are performed at almost the same time, and the writing processing is shorter than the reading processing, an updated image and the original (pre-update) image are concurrently displayed in an upper portion and a lower portion of the display screen 43, respectively, as shown in FIG. 9E when an update screen is displayed.

Figure 10A:
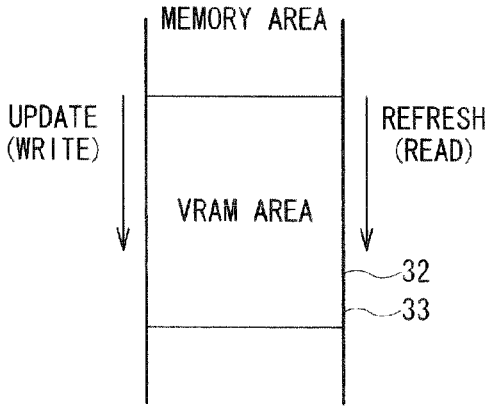
FIG. 10A shows an example of a way how a memory area is used when the portable terminal performs display control processing.
Figure 10B:
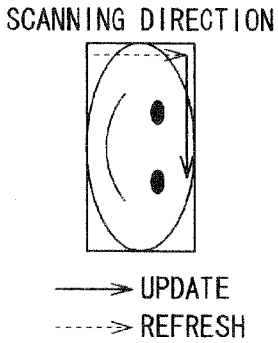
FIG. 10B shows a direction (update direction) in which display data is written and a direction (refresh direction) in which display data is read on a display.
Figure 10C:
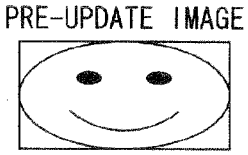
FIG. 10C shows the original (pre-update) image displayed on a display.
Figure 10D:
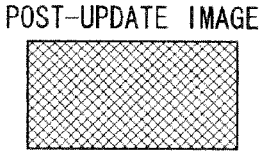
FIG. 10D shows an updated (post-update) image displayed on a display.
Figure 10E:
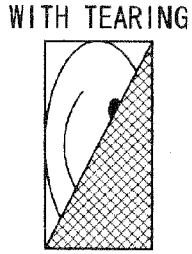
FIG. 10E shows a screen example displayed on a display.

FIGS. 10A to 10E show an example of how tearing occurs in the case where a direction (update direction) in which display data is written is different from a direction (refresh direction) in which display data is read on the display 13. FIG. 10A shows an example of how a memory area is used when the cellular phone 1 performs display control processing. FIG. 10B shows a direction (update direction) in which display data is written and a direction (refresh direction) in which display data is read on the display 13. FIG. 10C shows the original (pre-update) image displayed on the display 13. FIG. 10D shows an updated mage displayed on the display 13. FIG. 10E shows a screen example displayed on the display 13.

As shown in FIGS. 10A to 10E, if a rate (update rate) at which update data is written to the VRAM (the first VRAM 32 or the second VRAM 33) is different from a rate (refresh rate) at which update data is read from the VRAM and in this case, a write direction and a read direction are different, tearing diagonally occurs in the display screen 43. For example, if writing processing and reading processing are performed at almost the same time, and the writing processing is shorter than the reading processing, an updated image and the original (pre-update) image are concurrently displayed in an upper left portion and a lower night portion of the display screen 43, respectively, as shown in FIG. 10E when an update screen is displayed.

Thus, in the case where the writing direction and the reading direction are the same, for example, tearing appears in the same direction as a screen side direction (in other words, scrolling direction) and thus does not bother a user so much, and a high display processing speed precedes a high image quality of the display screen. On the other hand, if the writing direction is different from the reading direction, tearing appears obliquely across the screen and discomforts a user, and a high image quality of the display screen is prioritized.

In view of the above advantages and disadvantages, in the cellular phone 1, at the time of updating the display screen 43, if a high display processing speed is prioritized at the time of updating the display screen 43, more specifically, if the UI screen layer 40 is to be updated, or if the direction in which the update data is written is the same as the direction in which the update data is read, the data displayed on the display 13 is controlled based on single-buffer control (single buffer), and if a high image quality of the display screen is prioritized, more specifically, if the multimedia screen layer 41 is to be updated, or if the direction in which the update data is written is different from the direction in which the update data is read, the data displayed on the display 13 is controlled based on double-buffer control (double buffer).

Figure 11:
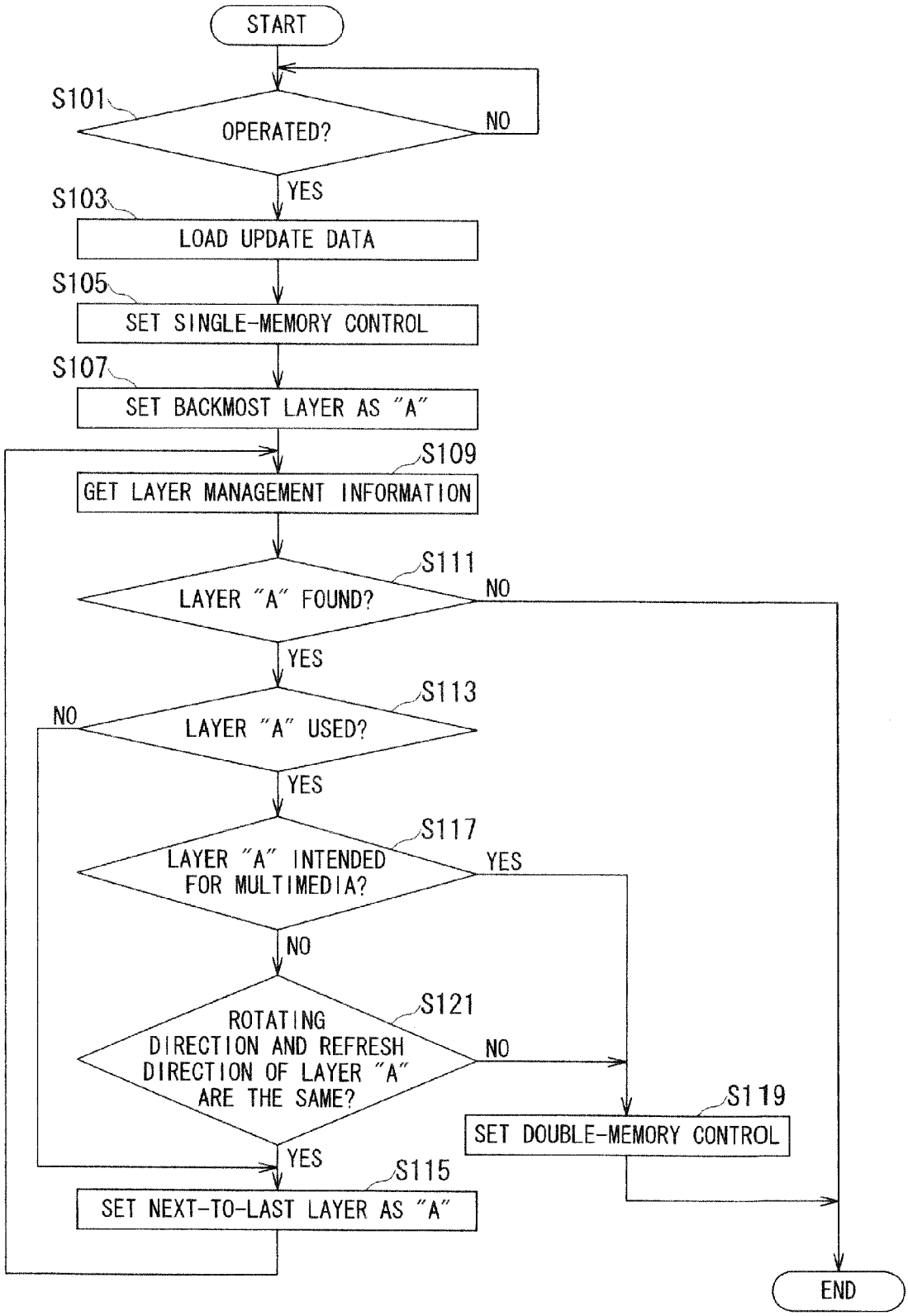
FIG. 11 is a flowchart of a procedure of the display control processing in the portable terminal according to the present invention.

In this way, the cellular phone 1 can improve a performance in updating the screen without modifying an application program to be executed, by selecting a method for controlling displayed data in the middleware based on plural screen layers generated with the running application program. A procedure for display control processing in the cellular phone 1 will be described with reference to a flowchart of FIG. 11. In the following description, "step" is abbreviated such that "step S101" is abbreviated to "S101".

When the cellular phone 1 is operated, if the display screen 43 on the display 13 needs to be updated because a user input has been made through the operation keys 15, data has been received through a mail browser, or current processing has been terminated, for example, the main control unit 20 serves to generate update data for the display screen 43 under the control of the application program and to update the display screen 43 on the display 13 according to the control of the middleware based on a VRAM control method appropriate for the update data.

First, the main control unit 20 determines whether the cellular phone 1 was operated (S101). If the cellular phone 1 was not operated ("NO" in S101), the main control unit 20 holds standby. On the other hand, if the cellular phone 1 was operated ("YES" in S101), the main control unit 20 loads update data generated under the control of the application program (S103). Then, the main control unit 20 sets single-buffer control (single buffer) as a display control method for the display 13 at default settings (S105).

Figure 12:
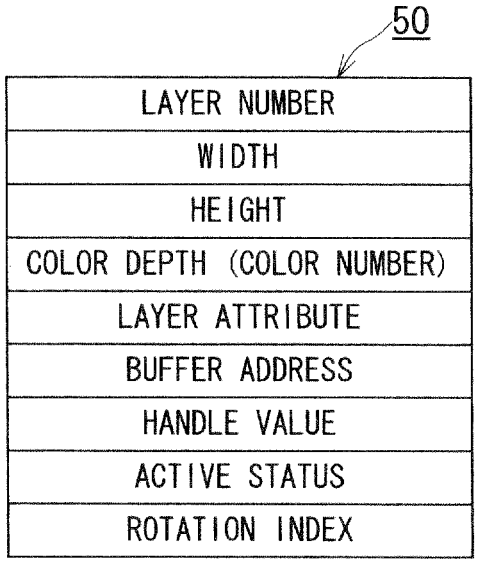
FIG. 12 shows data structure of layer management information.

The main control unit 20 gets the backmost screen layer and sets the layer as "A" (S107). The main control unit 20 obtains layer management information 50 about the screen layer gotten in S107 (S109). The layer management information 50 is managed by the middleware based on the arrangement in a number corresponding to the number of layers. As shown in FIG. 12, the layer management information 50 includes a layer number, a width, a length, a color depth (color number), a layer attribute, a buffer address, a handle value, an active status, a rotation index, and other such information.

The layer number is information representing a layer identifier as well as the sequence of screen layers. For example, the layer number is set to "0" for the backmost screen layer and incremented by 1 toward the foremost layer. The layer attribute is information representing, for example, whether a target layer is a UI screen layer or a multimedia screen layer. Here, if the layer attribute indicates the UI screen layer, its application is preset, and thus, the middleware stores an image buffer to be transferred to the driver. If the layer attribute indicates the multimedia screen layer, a screen size or the number of frame images is variable and thus, the middleware does not include a buffer.

In the case where the screen layer is being used, the handle value is issued and indicates information about a user of the screen layer. Further, the active status is information about whether the screen layer is being used (actually used in the application program). If the screen layer is being used (allocated), the handle value is issued but the active status is set to separately control whether the layer is actually displayed. The rotation index is information about whether displayed data is rotated.

The main control unit 20 determines whether the screen layer "A" obtained in S109 has been found (S111). At this time, the main control unit 20 determines whether the screen layer "A" has been found based on the handle value in the layer management information 50 obtained in S109. If the screen layer "A" has not been found ("NO" in S111), the processing returns to S101 and the main control unit 20 waits until the cellular phone 1 is operated again.

If the screen layer "A" has been found ("YES" in S111), the main control unit 20 determines whether the screen layer "A" is being used (S113). At this time, the main control unit 20 determines whether the screen layer "A" is being used based on the active status in the layer management information 50 obtained in S109.

If the screen layer "A" is riot being used ("NO" in S113), the main control unit 20 continues the single-buffer control as the display control method for the display 13 and in addition, a screen layer next to the backmost screen layer obtained in S107 is obtained, and the layer is set as "A" (S115). Then, the processing returns to S109 and the main control unit 20 loads layer management information 50 for the new layer "A".

If the screen layer "A" is being used ("YES" in S113), the main control unit 20 determines whether the screen layer "A" is a multimedia screen layer (S117). At this time, the main control unit 20 determines whether the screen layer "A" is a multimedia screen layer based on a layer attribute in the layer management information 50 loaded in S109.

If the screen layer "A" is a multimedia screen layer ("YES" in S117), a higher priority is given to a high image quality of the display screen. Thus, the main control unit 20 sets a double-buffer control (double buffer) to the display control method for the display 13 (S119). Then, the processing returns to S101 and the main control unit 20 waits until the cellular phone 1 is operated again.

If the screen layer "A" is not a multimedia screen layer ("YES" in S117) but a UI screen layer, for example, the main control unit 20 determines whether a rotating direction of the screen layer "A" is the same as a refresh direction (S121). At this time, if a direction in which the update data is written to the first VRAM 32 (or the second VRAM 33) and a direction in which the update data is read therefrom are the same, the main control unit 20 determines that a rotating direction of the screen layer "A" is the same as a refresh direction.

If a rotating direction of the screen layer "A" is the same as a refresh direction ("YES" in S121), the tearing is suppressed upon refreshing and thus, the main control unit 20 continues single-buffer control as the display control method for the display 13, gets the next screen layer to the layer obtained in S107 and sets the layer as "A" (S115).

If a rotating direction of the screen layer "A" is different from a refresh direction ("NO" in S121), the degree of the tearing is high upon refreshing and thus, the main control unit 20 sets the double-buffer control (double buffer) as the display control method for the display 13 (S119). Then, the processing returns to S101 and the main control unit 20 waits until the cellular phone 1 is operated again.

Figure 13:
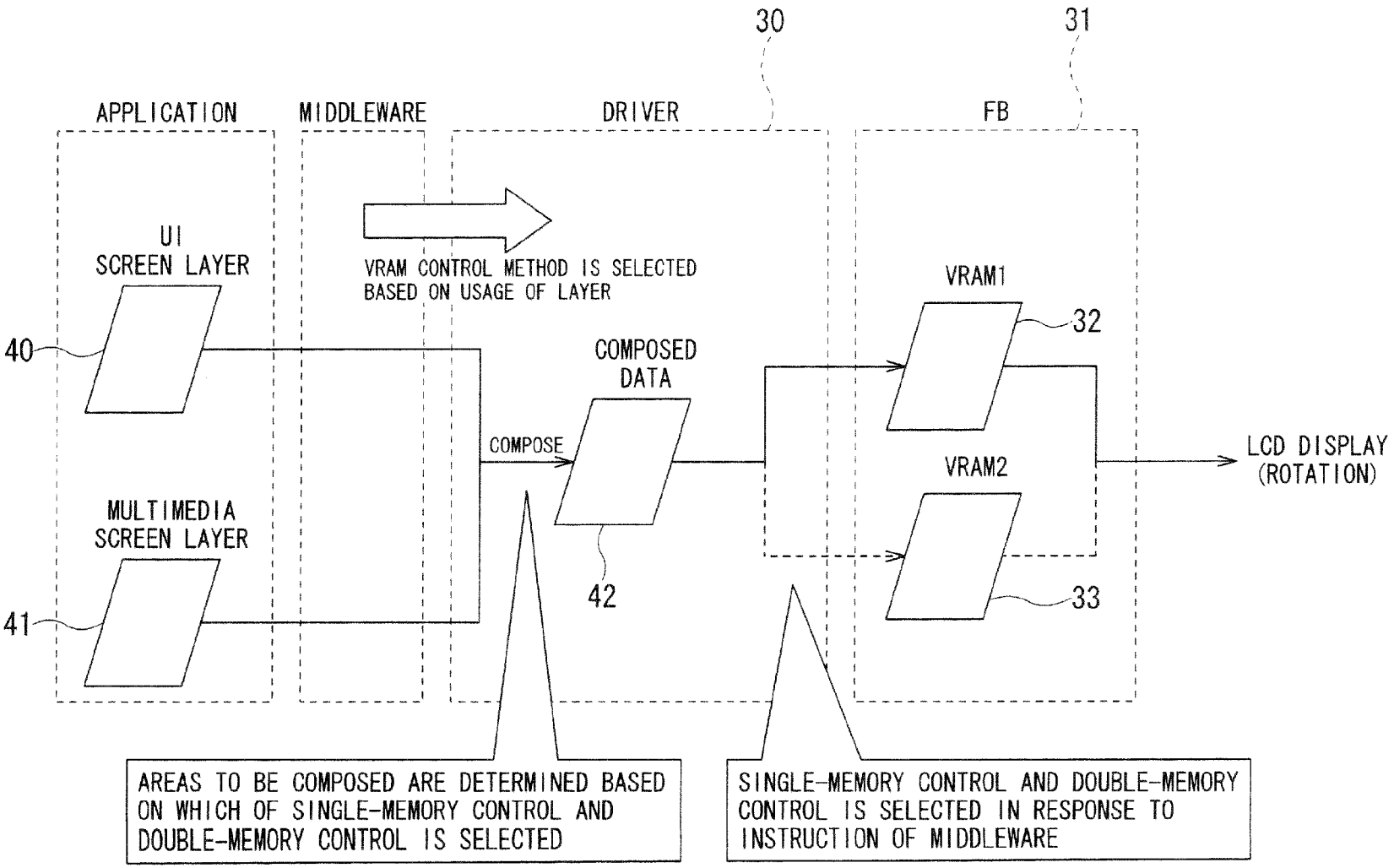
FIG. 13 is a schematic diagram of the display control processing in the portable terminal according to the present invention.

In this way, as shown in FIG. 13, attributes are assigned to a screen layer according to the application (UI screen layer 40 or multimedia screen layer 41, for example) and managed in the middleware. The middleware checks the management information to determine data displayed on the terminal and notifies the driver 30 of the displayed data. If the multimedia screen layer 41 is used, the middleware determines that moving images or equivalent attributes are being displayed and requests the driver 30 to execute the double-buffer control on the VRAM. If the multimedia screen layer 41 is not used, the middleware determines that a high image quality is not necessary for a current scene and requests the driver 30 to execute single-buffer control on the VRAM. Then, the driver 30 changes the VRAM control method according to the notification from the middleware.

Here, as for the processing for referencing a memory upon refreshing the display 13 in the cellular phone 1, the reference start point and the scanning direction are preset and thus, during single-buffer control, the tearing is conspicuous unless the memory updating direction and the scanning direction for refreshing are the same. Therefore, if the data is displayed not in the normal direction (in general cellular phones, turn sideways), the double-buffer control is executed even upon the UI screen display like the mail screen or the menu screen. If the memory updating direction and the scanning direction for refreshing are the same, the single-buffer control is selected. Otherwise, the double-buffer control is selected.

The middleware performs the above determination at the time when a request to start/terminate use of a screen layer is issued or an attribute (rotation index) is changed. The request or the change is made when the cellular phone 1 is operated, for example.

According to the portable device of the present invention of the characters mentioned above, the VRAM control methods are switched based on displayed data to thereby enable improvement in performance for updating the screen. In addition, since a load is reduced, responsiveness to a user operation can be increased.

It is further to be noted that although the present invention is described based on the cellular phone 1, it is not limited thereto, and the present invention is applicable to any portable terminal that executes screen display processing, such as a PHS (Personal Handy-phone System), a PDA (Personal Digital System), a PC (Personal Computer), a music player, a digital camera, and a game machine.

What is claimed is:

1. A portable terminal comprising:

a display unit configured to display a screen;

a first buffer and a second buffer configured to sequentially store display data for the screen displayed by the display unit;

a first determination unit configured to determine whether single-buffer control or double-buffer control is performed based on update data for the screen displayed by the display unit;

a setting unit configured to set, if the first determination unit determines that the single-buffer control is appropriate, a display control method of the display unit to a display control method using the first buffer and to set, if the first determination unit determines that the double-buffer control is appropriate, a display control method of the display unit to a display control method using the first buffer and the second buffer;

a second determination unit configured to determine whether a direction in which data is written to the first buffer or the second buffer is the same as a direction in which data is read from the first buffer or the second buffer, and the first determination unit determines that single-buffer control is appropriate if the second determination unit determines that the two directions are the same and determines that double-buffer control is appropriate if the second determination unit determines that the two directions are not the same; and a switch part configured to switch a transfer source of the update data between the first buffer and the second buffer, wherein the switch part is configured to switch the transfer source so that the update data in the first buffer and the update data in the second buffer alternately update the screen displayed by the display unit if the setting unit sets the display control method of the display unit to the display control method using the first buffer and the second buffer, and wherein the update data in the first buffer and the update data in the second buffer are configured to be directly input to the display unit, wherein the display control method using the first buffer is set as the display control method of the display unit as a default setting.

2. The portable terminal to claim 1, further comprising a storage unit configured to store attribute information of the screen displayed by the display unit, wherein the first determination unit determines whether the single-buffer control or the double-buffer control is performed based on the attribute information stored in the storage unit.

3. The portable terminal to claim 2, wherein the storage unit is configured to store information as to whether target data is a moving image as the attribute information of the screen or not, and the first determination unit is configured to determine that single-buffer control is appropriate if the data displayed by the display unit is not a moving image, based on the attribute information stored in the storage unit and determines that the double-buffer control is appropriate if the data displayed with the display unit is a moving image, based on the attribute information stored in the storage unit.

4. The portable terminal to claim 3, wherein the storage unit stores the attribute information of each of a plurality of layers in the screen displayed by the display unit, and the first determination unit determines that the double-buffer control is appropriate if one of the plurality of layers is a moving image, based on the attribute information stored in the storage unit and determines that the single-buffer control is appropriate if none of the plurality of layers is a moving image, based on the attribute information stored in the storage unit.

* * * * *